US005293931A

United States Patent [19]

Nichols et al.

[11] Patent Number: 5,293,931

[45] Date of Patent: Mar. 15, 1994

[54] MODULAR, MULTI-LEVEL GROUNDWATER SAMPLER

[76] Inventors: Ralph L. Nichols, 812 Plantation Point Dr., N. Augusta, S.C. 29841; Mark A. Widdowson, 4204 Havana Ct., Columbia, S.C. 29206; Harry Mullinex, 10 Cardross La., Columbia, S.C. 29209; William H. Orne, 12 Martha Ct., Sumter, S.C. 29150; Brian B. Looney, 1135 Ridgemont Dr., Aiken, S.C. 29803

[21] Appl. No.: 966,267

[22] Filed: Oct. 26, 1992

[51] Int. Cl.[5] ..... E21B 49/08

[52] U.S. Cl. ..... 166/54.1; 73/155; 166/68; 166/106; 166/113; 166/264

[58] Field of Search ..... 166/264, 54.1, 68, 106, 166/113, 100; 73/155

[56] References Cited

U.S. PATENT DOCUMENTS

| | | | |
|---|---|---|---|
| 1,547,240 | 7/1925 | Steele | 166/264 |
| 2,511,759 | 6/1950 | Williams | 166/106 X |
| 2,781,663 | 2/1957 | Maly et al. | 166/264 |
| 3,103,813 | 9/1963 | Bourne, Jr. et al. | 166/264 |
| 3,254,710 | 6/1966 | Jensen | 166/264 |
| 4,392,376 | 7/1983 | Lagus et al. | 73/155 |
| 4,538,683 | 9/1985 | Chulick | 166/264 |
| 4,690,216 | 9/1987 | Pritchard, Jr. | 166/264 |
| 4,745,801 | 5/1988 | Luzier | 166/264 |
| 5,224,389 | 7/1993 | Jensen et al. | 166/264 X |
| 5,238,060 | 8/1993 | Niehans et al. | 166/68 |

*Primary Examiner*—Hoang C. Dang

*Attorney, Agent, or Firm*—Michael A. Mann

[57] ABSTRACT

Apparatus for taking a multiple of samples of groundwater or pressure measurements from a well simultaneously. The apparatus comprises a series of chambers arranged in an axial array, each of which is dimensioned to fit into a perforated well casing and leave a small gap between the well casing and the exterior of the chamber. Seals at each end of the container define the limits to the axial portion of the well to be sampled. A submersible pump in each chamber pumps the groundwater that passes through the well casing perforations into the gap from the gap to the surface for analysis. The power lines and hoses for the chambers farther down the array pass through each chamber above them in the array. The seals are solid, water-proof, non-reactive, resilient disks supported to engage the inside surface of the well casing. Because of the modular design, the apparatus provides flexibility for use in a variety of well configurations.

10 Claims, 2 Drawing Sheets

MODULAR, MULTI-LEVEL GROUNDWATER SAMPLER

The United States Government has rights in the present invention pursuant to Contract No. DE-AC09-89SR18035 between the U. S. Department of Energy and Westinghouse Savannah River Company.

BACKGROUND OF THE INVENTION

1. Field of the Invention

The present invention relates to groundwater sampling. More particularly, the present invention relates to sampling of groundwater at several vertical positions simultaneously.

2. Discussion of Background

Groundwater monitoring involves the analysis of the constituents present in groundwater and the direction and rate of flow of the groundwater. Since groundwater is a significant source of water for drinking, recreation and irrigation, its supply and constituents are of paramount importance. Contaminants present as a constituent in the groundwater can pose a significant problem, sometimes even in trace amounts. Therefore, groundwater monitoring to detect the presence of contaminants is important in protecting the supply of water.

Groundwater monitoring begins with taking a sample of the water and analyzing it for its constituents. However, to properly characterize a groundwater system, a number of samples must be taken at different locations to ascertain how the concentrations of the constituents vary from one location in the system to another and how they change over time so that the evolution of the system can be traced and predicted.

A groundwater system is three-dimensional, requiring sampling from different locations in a horizontal plane and in the vertical direction. Usually, a series of monitoring wells are dug at preselected locations throughout an area where the groundwater system is of interest. These wells are about four inches (ten centimeters) in diameter. The sides of the wells are shored by the insertion of well casing, which is perforated piping. Groundwater passes through the perforations in the casing into the well.

There are several devices for sampling groundwater at multiple elevations in a single well; typically, these have a vertical series of chambers that each permit entrance of a sample of well fluid. See, for example, the descriptions in U.S. Pat. No. 4,745,801 issued to Luzier, U.S. Pat. No. 4,538,683 issued to Chulick, U.S. Pat. No. 3,254,710 issued to Jensen, and U.S. Pat. No. 2,781,663 issued to Maly et al. Portions of the axial dimension, defined by the axis of the well, are established by sealing the chamber to the well casing using gaskets; these gaskets are inflated to seal against the casing when needed and to disengage the casing when not in use. See Maly, et al. for examples of inflatable and fixed seal. Maly, et al. fill each chamber using a solenoid valve to control admission of groundwater. Then, the array of chambers is removed from the well for analysis rather than pumping the contents of the chambers to a remote location for analysis.

In some cases, the fluid from the chambers is pumped to the surface at the top of the well rather than being removed along with the chambers when they are pulled from the well. In most cases, a pump at the well head is used for pumping groundwater samples to the surface. The use of submersible pumps in samplers, however, is also known. Chulick, cited above, uses a single submersible pump for all levels when depth of the sampler requires it. Chulick samples one level at a time by rotating an inner cylinder until its perforations line up with the level selected; then groundwater passes through the perforations into the sampler.

In an approach different from that of Chulick, Luzier uses small diameter tubes to collect simultaneously samples of groundwater at different depths. Each tube is perforated at a different depth and covered with multiple wraps of stainless steel screen. His pump is located at the surface rather than in each tube.

The inflatable seals used in some multi-level samplers require a source of air or other gas for inflating and also pose the possibility that they may rupture, so their reliability is suspect. Surface pumps rather than submersible pumps can only pump water from a depth of less than 30 feet and therefore limited use to shallower wells.

There remains, however, a need for a simple, flexible apparatus for sampling the groundwater and measuring pressure at different elevations along the axis of the well casing simultaneously and without cross contamination between levels. Preferably, such an apparatus would be field-assembled from modular units to meet for a variety of well configurations and be retrievable following use from one well for use in another. There is also a need for apparatus for determining the rate and direction of contaminant transport in an aquifer which can be done based on measurements of groundwater pore pressure at various locations within the aquifer.

SUMMARY OF THE INVENTION

According to its major aspects and broadly stated, the present invention is an apparatus for enabling the taking of samples of groundwater and measuring groundwater pressure at multiple levels simultaneously. The apparatus comprises an axial array of generally cylindrical devices or chambers, each housing a small submersible pump and dimensioned to fit within a standard, perforated well casing so that a small annular gap remains between the exterior surface of the chamber and the interior surface of the well casing. Disks at each end of the device seal it to the well casing and define thereby the axial limits of the gap. A pressure transducer senses pressure and produces a corresponding electrical output signal.

The pump communicates with the groundwater in the annular gap, pumping a sample from the groundwater that passes through the perforations of the well casing into the gap to a remote location for analysis. By running the power lines and sample transfer hoses through the interiors of the devices above it, the submersible pump in each device in the array can pump a sample to the remote location simultaneously.

The nesting of power lines and transfer hoses is an important feature of the present invention. A typical well casing is only approximately four inches (10 centimeters) in diameter. The devices that comprise the array are slightly smaller in diameter but have a sufficiently large interior to place a submersible pump for the sample from that device and also pass the power lines and hoses from a substantial number of devices further down the axial array through the device and on to the remote location. Nesting allows the positioning of an array of devices at various depths in the well, and at depths much greater than would be possible if submersible pumps were not used, for simultaneous sampling of levels.

Another important feature of the present invention is the use of submersible pumps in each of the devices in the array. Individual pumps enable each device to be placed anywhere along the array and still provide pumping power for that sample. Submersible pumps enable each chamber to pump its sample to the surface when located at a depth greater than would be possible from a pump placed near the well head. Unlike surface pumps, small submersible pumps can pump water from a depth greater than approximately 30 feet.

Still another important feature of the present invention is the configuration of the chamber itself. It is dimensioned to fit inside the well casing leaving a sufficient gap for a sample of groundwater to occupy between the chamber and the well casing. Good monitoring procedure requires the purging of groundwater in this annular region four times before a sample is taken, and since the purge water may need to be handled in accordance with law, the less this volume is, the smaller the quantity of purge water that must be disposed of. The chamber's ends are threaded in order to be able to connect two chambers together or to standard two-inch (five centimeter) well piping or to stack a series in a one-dimensional array. Each chamber is identical and carries its own submersible pump. Therefore, in-the-field assembly of the chambers in the axial array is simplified and reuse in another well is possible for reduced capital expenditures.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
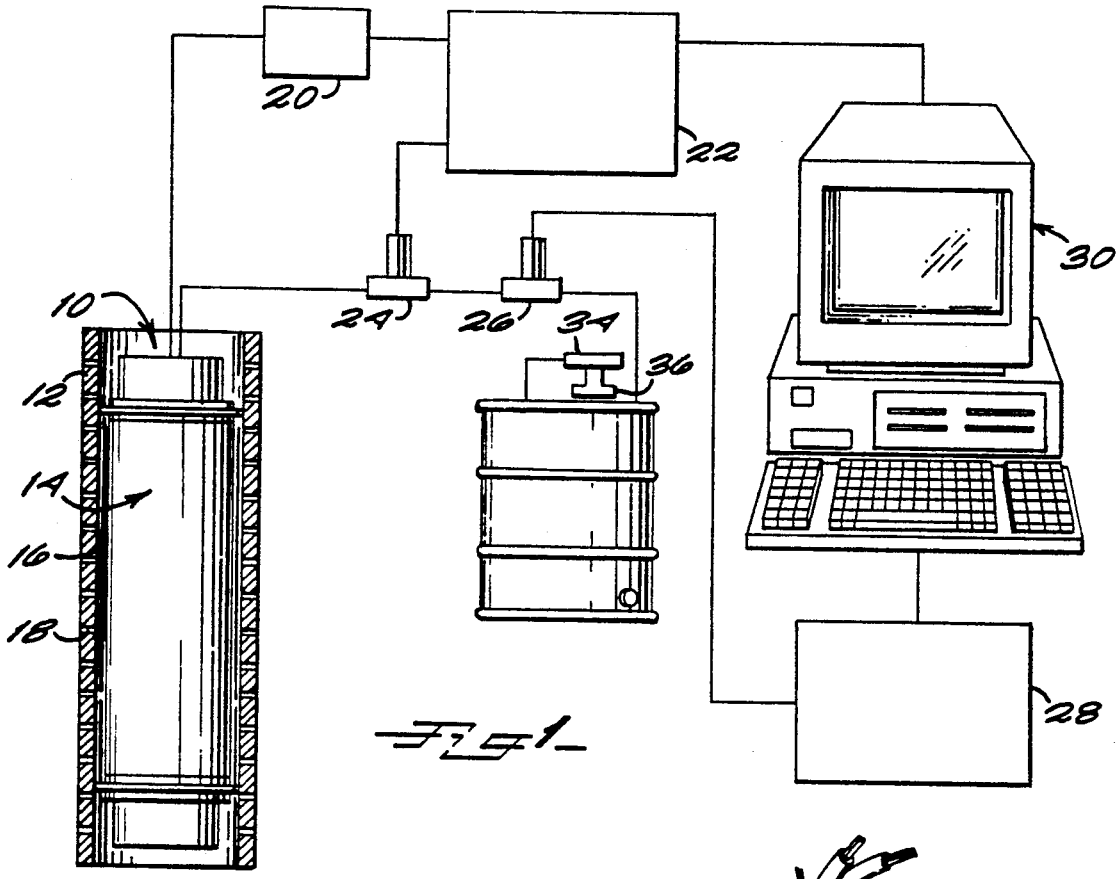
FIG. 1 illustrates a typical example of a system wherein an apparatus according to a preferred embodiment of the present invention would be used.

Referring now to FIG. 1, which illustrates a typical example of a configuration in which the present apparatus might be used, there is a well 10 having a well casing 12 shoring its sides. Well casing 12 is typically four inches (ten centimeters) in diameter. Thus, the space for inserting monitoring equipment is not very great. The present invention, a generally cylindrical chamber 14 is inserted into well 10. Chamber 14 is dimensioned to fit into casing 12 leaving a small gap 16 into which groundwater, passing through perforations 18 in well casing 14, can flow. The sample is pumped on signal from a pump control 20, controlled in turn by a well data logger 22, to a series of flow cells 24, 26. Flow cells 24, 26 are in optical communication with a source of light (not shown) and a spectrophotometer 28. The constituents of the water sample are determined by directing light carried by optic fibers to flow cells 24, 26 to measure the absorption spectrum of the sample. The amount of light absorbed by the sample as a function of wavelength correlates to the concentration of the absorbing substance. Well logger 22 controls the logging and sequencing of data. A programmed general purpose computer 30 can be used to analyze and display the data. The sample is passed to a storage container 32 after analysis for proper disposal. Groundwater samples can be captured using a two-way valve 34 and a bottle 36 before the balance of the sample is passed to container 32. The captured sample is stored in sample bottle 36 for various laboratory analyses. Pump control 20, data logger 22, flow cell 24, flow cell 26, spectrophotometer 28, computer 30, valve 34, bottle 36 and storage container 32 are placed at a location remote from well 10; each may be separated from each other as desired but they are remote from well 10.

Figure 2:
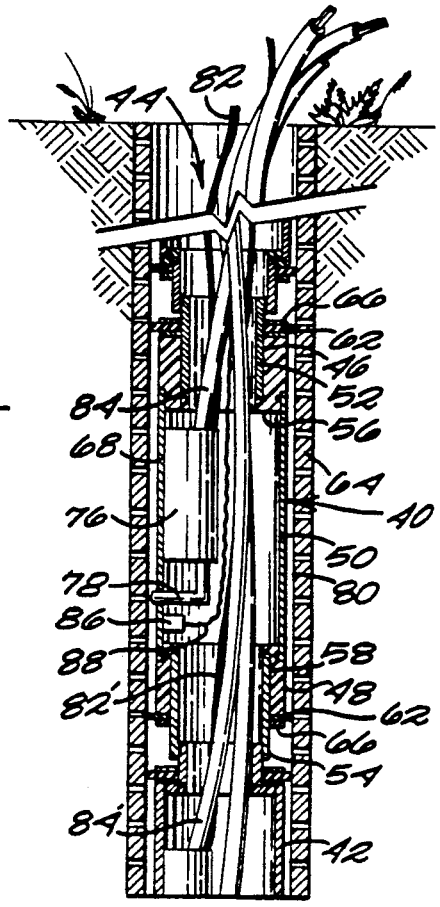
FIG. 2 illustrates an apparatus according to a preferred embodiment of the present invention.
Figure 3:
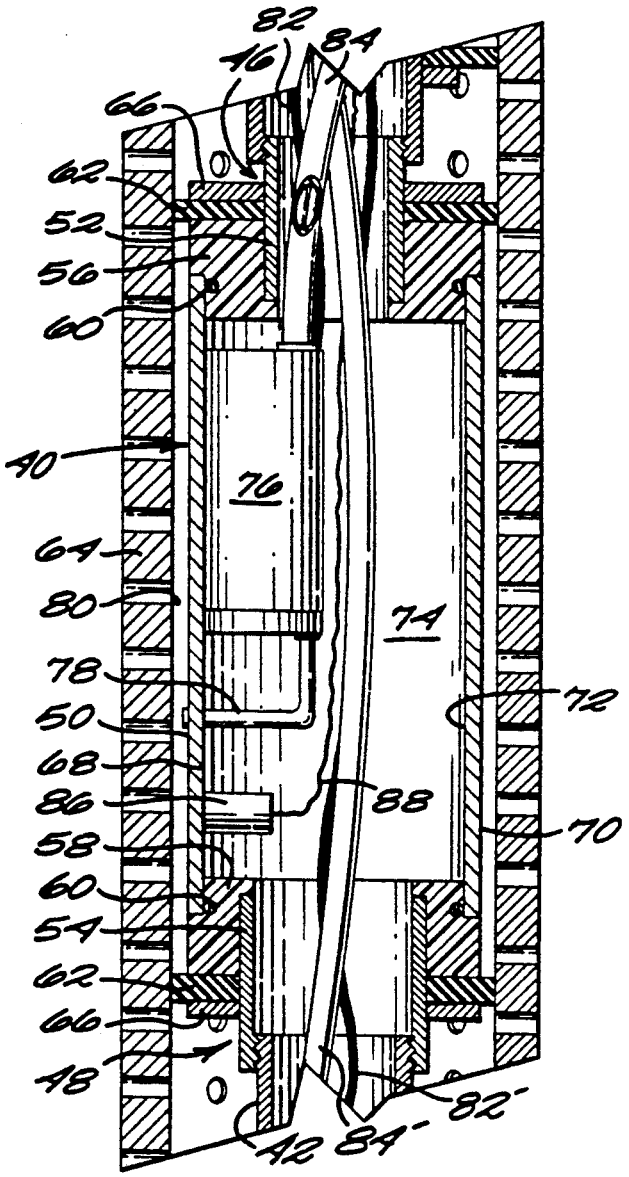
FIG. 3 illustrates the apparatus of FIG. 2 showing additional detail.

Referring now to FIGS. 2 and 3, showing cross-sectional side views, the present invention is a chamber 40 that can be connected to another, identical chamber 42 directly or indirectly, to form a one-dimensional, axial array and placed into a well 44, coaxial with well 44, and used to monitor the groundwater at a number of levels or elevations in well 44.

Chamber 40 is generally cylindrical and has a first end 46 and a second end 48. The body of chamber 40 is preferably made of a body cylinder 50 having a first diameter and two end cylinders 52, 54, a first end cylinder 52 having a second diameter and a second end cylinder 54 having a third diameter. Second and third diameters are both smaller than first diameter. First and second end cylinders 52, 54 are joined to body cylinder 50 by first and second end fittings 56, 58, respectively. Gaskets 60 are used to seal body cylinder 50 to first and second end cylinders, 52, 54.

First and second ends 46, 48 of chamber 40 each carry a disk 62 oriented to lie in a plane at right angles with respect to the axis of chamber 40 and well 44. Disk 40 is dimensioned to be slightly larger than the diameter of well casing 64 and is selected from materials that are resilient, water-proof and non-reactive with other materials and contaminants likely to be found in the subsurface environment. In many cases, rubber is suitable, but TEFLON® or V-YTON® or other synthetic material can be selected. In particular, disk should not be degraded by groundwater or contribute to the constituents of the groundwater. Disks 62 are supported and attached to first and second end fittings 56, 58 of chamber 40.

Chamber 40 has a wall 68 with an exterior surface 70 and an interior surface 72. Interior surface 72 defines an interior space 74 that holds a small submersible pump 76, preferably not more than two inches in diameter and most preferably less than one inch in diameter. Pump 76 has a small connector 78 that leads from pump 76 to gap 80, penetrating wall 68 of chamber 40, and enabling fluid communication between pump 76 and the groundwater in gap 80. Pump 76 communicates with a remote location at the top of well 44 via a small diameter hose 82. Power to pump 76 is supplied by a power line 84 from the remote location.

Each power line 84, 84' and each hose 82, 82' runs to its chamber 40, 42 through the interior space of each chamber 40, 42, respectively, that precedes it in the axial array. In other words, if the closest chamber to the surface of the well is chamber number one, and it is followed in turn by chamber two then chamber three, chamber three's power line and hose run through chambers two and one. A pressure transducer 86 can be placed in chamber 40, mounted to body cylinder 50, and connected to data logger 22 by electrical wiring 88.

First end cylinder 52 and second end cylinder 54 are threaded so that one chamber can be connected to another, second end of a first cylinder threaded to a first end of a second cylinder, or with a length of standard two-inch (five centimeter) monitoring pipe threaded between two sequential cylinders in an axial array. In its modular configuration, the apparatus of the present invention can be configured to fit a variety of wells and configured differently for the same well. Moreover, the simplicity of the connection of one chamber 40 to another enables field assembly with minimal training and equipment. Finally, the construction of the apparatus allows retrieval and reconfiguration.

Well data logger 22 (FIG. 1) can be of a type such as CR10 data logger made by CAMPBELL SCIENTIFIC, which can record data measurements every five or ten minutes. Data logger 22 turns on pumps, and records data that can be down loaded into computer 30.

Small submersible pumps made by KV & Assoc. Inc., designated XP 100 Series Purge and Sampling Minipump System are suitable as are small submersible pumps made by Fultz and Westinghouse.

In use, monitoring wells are bored in an array on the surface of a tract of land where well monitoring is to be done and well casing is slipped into each well. Then an axial array of cylinders is constructed for each well where multiple levels will be sampled. The axial array can include chambers connected directly to each other, separated by lengths of two-inch monitoring pipe, or a combination of both. Monitoring pipe can be screwed together and sampler spacing is field determined. The power lines and hoses from each chamber are threaded through the interior space of each chamber following it in the array. The completed axial array is lowered into the well.

Once lowered to the desired depth and with all power lines and hoses attached to pump control and to flow cells, the gap between each chamber and the well casing is pumped until a volume of groundwater equal to four times the volume of the gap has been purged from each chamber. Then the sample is taken and pumped by the submersible pump to the remote location for analysis using the flow cells and the spectrophotometer or capture in a sample bottle.

When each chamber in the array has produced a sample for analysis, or several samples over a period of time, it can be removed and transferred to another well.

In an alternative embodiment, the single disk on first end and second end can be replaced by three or four O-rings. The material requirements on the O-rings—resilient, water-proof, non-reactive— would remain the same as for disks. Using a one-inch submersible pump and a limited number of chambers, the present invention can be adapted to a two-inch-diameter well casing. Also, chamber can carry other instrumentation, for example, pressure transducers for measuring ambient fluid pressure.

It will be apparent to those skilled in the art that many other changes and substitutions can be made to the preferred embodiment herein described without departing from the spirit and scope of the present invention as defined by the appended claims.

What is claimed is:

1. A device for use in taking samples of groundwater flowing into a hollow, cylindrical well casing, said well casing having an interior surface, and a plurality of perforations through which groundwater can pass, said samples being taken for analysis at a location remote from said device, said device comprising:

a hollow chamber having a first end and an opposing, second end, and an outside surface and an inside surface, said inside surface defining an interior space, said chamber dimensioned to fit coaxially within said well casing so as to form a gap between said inside surface of said well casing and said outside surface of said chamber and into which gap groundwater passing through said perforations of said well casing can flow, said chamber having a diameter and said first end having a second diameter smaller than said first diameter and said second end having a third diameter smaller than said second diameter;

means carried by said chamber on said exterior surface between said first end and said second for sealing said exterior surface of said chamber to said interior surface of said well casing, thereby defining the axial limits of said gap, wherein said sealing means further comprises:

a first resilient, water-proof disk about said first end;

first means carried by said first end for supporting said first disk in sealing engagement with said interior surface of said well casing;

a second resilient, water-proof disk about said second end; and second means carried by said second end for supporting said second disk in sealing engagement with said interior surface of said well casing;

a pump carried by said chamber and communicating with said gap, said pump adapted for pumping said sample of groundwater from said gap to said remote location;

a hose in operational connection with said pump and said remote location for conveying said sample from said pump to said remote location, said interior of said chamber dimensioned for carrying at least two of said hoses and said pump; and means formed on said first and second ends of said chamber for connecting said chamber to another chamber, said first end of said chamber connectable to said second end of said another chamber, so that several chambers can be attached and aligned axially in said well casing for taking samples at several axial locations, said sealing means defining a different axial location for taking a sample of groundwater by each of said several chambers.

2. The device as recited in claim 1, wherein said pump is a submersible pump having a diameter less than five centimeters.

3. The device as recited in claim 1, wherein said first end and said second end of said chamber are threaded so that two such chambers can be threadably connected together, a second end of a first of said such chambers connected to a first end of a second of said such chambers.

4. The device as recited in claim 1, wherein said first and said second resilient, water-proof disk are non-reactive.

5. An apparatus for taking simultaneously two samples of groundwater from a well lined with a well casing, said well casing having multiple perforations through which perforations groundwater may pass, each sample of said two samples to be taken at a different location along the axis of said well for analysis at a location remote to said well, said apparatus comprising:

a first hollow chamber;

a second hollow chamber, said first and said second hollow chambers each having a first end and a second end and dimensioned to fit within, said well casing leaving a gap between said well casing and said first and second chamber;

means for connecting said first chamber to said second chamber to form an axial array of chambers, said second chamber following said first chamber in said axial array, said second end of said first chamber attachable to said first end of said second chamber;

means carried by said first and said second chambers for sealing said first and second ends of said first and second chambers, respectively, to said well casing thereby defining a first axial portion of said gap and a second axial portion of said gap, respectively; and said first and said second chambers carrying a first and a second pump and a first and second hose, respectively, said first and said second pumps in fluid communication with said first and said second axial portions of said gap, respectively, said first and second hoses carrying samples from said first and second pumps, respectively, to said remote location, said first chamber dimensioned to carry within it said first pump, said first hose, and said second hose.

6. The apparatus as recited in claim 5, for use with a source of electrical power, wherein said first and said second pumps have a first and a second power line, respectively, for activating said first and second pumps, said first and said second power lines running from said source of power to said first and said second pumps, respectively, and said first chamber is dimensioned to carry within it said first and said second power lines.

7. The apparatus as recited in claim 5, wherein said, sealing means further comprises:

a first resilient, water-proof disk about each of said first ends of said first and second chambers; and first means carried by said first ends for supporting said first disks, in sealing engagement with said well casing;

a second resilient, water-proof disk about each said second ends; and second means carried by said second ends for supporting said second disks in sealing engagement with said well casing.

8. The apparatus as recited in claim 5, wherein said sealing means further comprises:

a first resilient, non-reactive, water-proof disk about each of said first ends of said first and second chambers; and first means carried by said first ends for supporting said first disks in scaling engagement with said well casing;

a second resilient, non-reactive, water-proof disk about each said second ends; and second means carried by said second ends for supporting said second disks in sealing engagement with said well casing.

9. The apparatus as recited in claim 5, wherein said first and said second pumps are submersible pumps having a diameter less than approximately five centimeters.

10. Apparatus for taking simultaneously two samples of groundwater from a well lined with a well casing, said well casing having multiple perforations through which perforations groundwater may pass, each sample of said two samples to be taken at a different location along the axis of said well for analysis at a location remote to said well, said apparatus comprising:

a first hollow chamber with a first diameter and having a first end with a second diameter smaller than said first diameter, and an opposing second end with a third diameter smaller than said first diameter, an exterior surface and an interior surface, said interior surface defining an interior space, a pump carried by said chamber in said interior space, said pump adapted for pumping a fluid sample from said chamber to said remote location, a hose for carrying said fluid sample to said remote location from said pump, first means for sealing said first end to said well casing, and second means for sealing said second end to said well casing;

a second hollow chamber with a first diameter and having a first end with a second diameter smaller than said first diameter, and an opposing second end with a third diameter smaller than said first diameter, an exterior surface and an interior surface, said interior surface defining an interior space, a pump carried by said chamber in said interior space, said pump adapted for pumping a fluid sample from said chamber to said remote location, a hose for carrying said fluid sample to said remote location from said pump, first means for sealing said first end to said well casing, and second means for sealing said second end to said well casing;

said first and said second hollow chambers each having a first end and a second end and dimensioned to fit within said well casing leaving a gap between said well casing and said first and second chamber;

means for connecting first chamber to said second chamber to form an axial array of chambers, said second chamber following said first chamber in said axial array, said second end of said first chamber attachable to said first end of said second chamber;

means carried by said first and said second chambers for sealing said first and second ends of said first and second chambers, respectively, to said well casing thereby defining a first axial portion of said gap and a second axial portion of said gap, respectively; and said first and said second chambers carrying a first and a second pump and a first and second hose, respectively, said first and said second pumps in fluid communication with said first and said second axial portions of said gap, respectively, said first and second hoses carrying samples from said first and second pumps, respectively, to said remote location, said first chamber dimensioned to carry within it said first pump, said first hose, and said second hose.

* * * * *